US005881391A

United States Patent [19]

Mullaney

[11] Patent Number: 5,881,391

[45] Date of Patent: Mar. 16, 1999

[54] HAT FLAGS

[76] Inventor: David W. Mullaney, 12116 Falls Lake Cir., Raleigh, N.C. 27615

[21] Appl. No.: 979,040

[22] Filed: Nov. 26, 1997

[51] Int. Cl.[6] ..... A42B 1/24

[52] U.S. Cl. ..... 2/209.13; 2/244; 40/329; 116/173; D11/166

[58] Field of Search ..... 2/209.13, 244; 40/329; 116/173; D11/165, 166, 167, 181

[56] References Cited

U.S. PATENT DOCUMENTS

| | | | |
|---|---|---|---|
| 1,082,987 | 12/1913 | Williams . | |
| 1,108,649 | 8/1914 | Williams . | |
| 1,928,563 | 9/1933 | Hetzel . | |
| 2,013,271 | 9/1935 | Greenhoe . | |
| 3,104,644 | 9/1963 | Burton | 116/173 |
| 3,437,339 | 4/1969 | Starck . | |
| 3,540,685 | 11/1970 | Gualano . | |
| 4,035,856 | 7/1977 | Oberg . | |
| 4,599,965 | 7/1986 | Johnson . | |
| 4,611,355 | 9/1986 | Galanto et al. . | |
| 4,665,568 | 5/1987 | Stutes . | |
| 4,905,406 | 3/1990 | Warner . | |
| 5,167,559 | 12/1992 | Power-Fardy . | |
| 5,171,152 | 12/1992 | McCleery . | |
| 5,463,974 | 11/1995 | Seeder | 116/173 |
| 5,530,970 | 7/1996 | Knutson | 2/209.13 |
| 5,682,615 | 11/1997 | Wahl et al. | 2/209.13 |

*Primary Examiner*—Diana L. Biefeld
*Attorney, Agent, or Firm*—Richard S. Faust

[57] ABSTRACT

A pair of flags bearing a sports team's colors and/or logo are carried by a pair of upstanding standards that are removably secured to the opposing sides of the visor of a baseball-type cap. The standards are bendable to permit them to assume a desired (e.g. vertical) orientation once attached to the visor. The standards may also be rotatable about their longitudinal axes so that the flags may be oriented as desired by the wearer.

20 Claims, 6 Drawing Sheets

HAT FLAGS

FIELD OF THE INVENTION

The invention relates to headwear carrying flags, pennants or banners that are secured to the visor of the headwear.

BACKGROUND OF THE INVENTION

Sports enthusiasts have long sought novel and eye-catching ways to express loyalty to their teams through logo-bearing products such as headwear, pennants, shirts, jackets, and the like. The advent of formal licensing programs by sports teams at all levels of competition, both amateur and professional, along with the increased following of team sports by the general population, have resulted in a proliferation of logo-bearing products associated with sports teams.

Headwear products that are sports team oriented, most notably conventional baseball-type caps, usually display the color or colors of the team, along with a logo and/or team name located on the forward facing portion of the cap where it meets the visor. The display may be embroidered, screen printed, attached by adhesives, or otherwise permanently placed on the cap.

While conventional sports team oriented headwear has tremendous market appeal, there is a need for a fresh and novel approach to headwear displaying team loyalty.

SUMMARY OF THE INVENTION

The present invention provides a novel approach to using headwear to display team loyalty by removably attaching a flag or flags to the visor of the headwear. In one aspect, the invention may be defined as a flag assembly comprising an elongate standard with a flag attached to the upper end of the standard and a securement structure at the lower end of the standard for securing the standard to a visor. In one preferred embodiment, the standard is formed of bendable spring steel wire and the securement structure is an integrally formed coil. A marginal edge portion of the visor is press fit between adjacent turns of the coil to secure the assembly to the visor.

A pair of standards may be secured to opposite sides of the visor to display two flags. A pair of standards can also be used to carry a banner.

BRIEF DESCRIPTION OF THE DRAWINGS

Some of the objects having been stated, other objects will appear as the description proceeds, when taken in connection with the accompanying drawings, in which.

DETAILED DESCRIPTION OF THE INVENTION

While the present invention will be described more fully hereinafter with reference to the accompanying drawings in which aspects of the preferred manner of practicing the present invention are shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
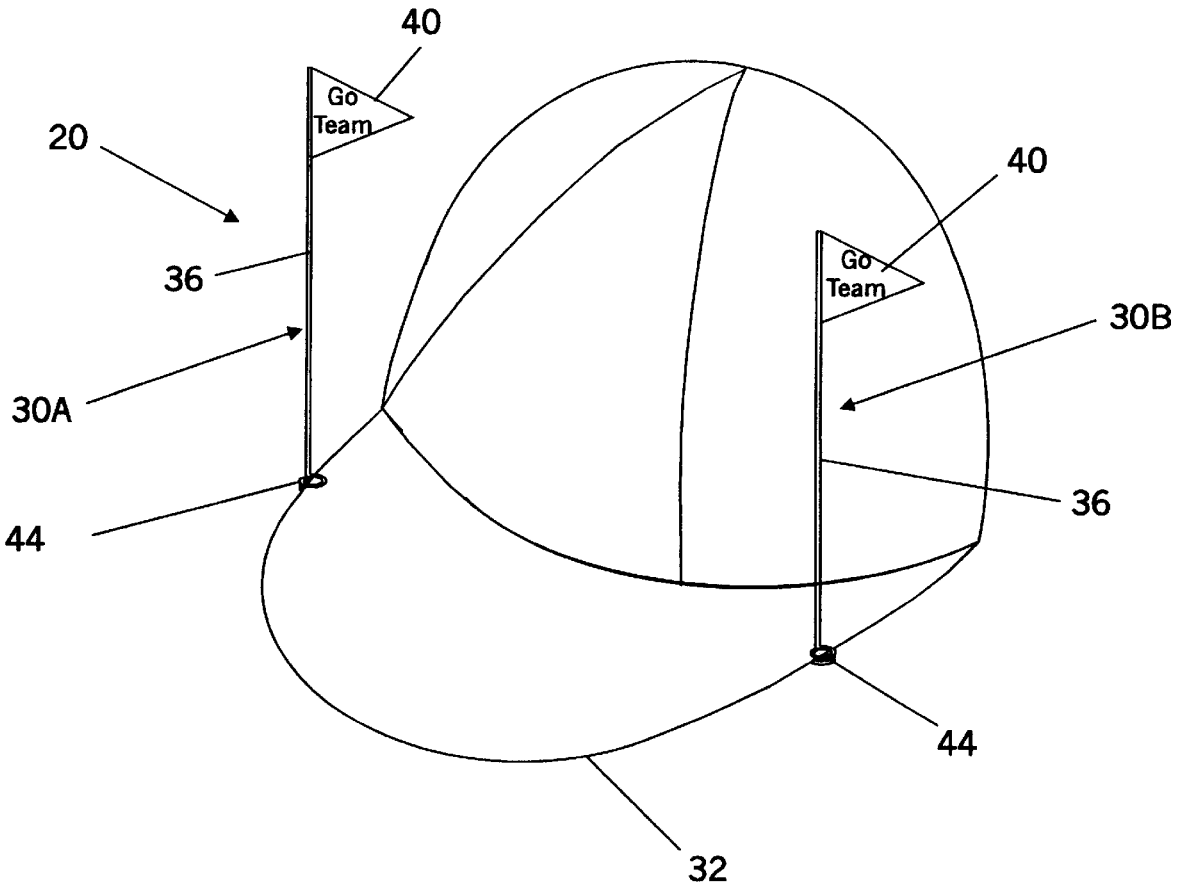
FIG. 1 is a pictorial view of a baseball-type cap carrying two flags attached to the visor.

Referring to the drawings, and particularly to FIG. 1, there is shown a conventional baseball-type cap 20 carrying two hat flags assemblies 30A, 30B of the present invention. The hat flag assemblies 30A, 30B are secured to opposing sides of the brim or visor 32 of cap 20. Each hat flag assembly includes an elongate standard 36 having a first end carrying a flag 40 and a second end with an associated securement structure 44 for removably securing the assembly to the visor. Flags 40 bear a logo, team name or other graphics showing the wearer's allegiance to a sports team. As explained below, once secured to the visor, each upstanding standard preferably is bendably adjustable so that the standard may extend in the direction desired by the wearer (usually vertical). Also, preferably, once secured to the visor, the standard is rotatable substantially about its longitudinal axis so that the flag may be oriented to suit the wearer. As shown in FIG. 1, in one preferred manner of practicing the invention, the standards are substantially vertically oriented with the flags 40 in a parallel, front-to-rear facing arrangement.

Figure 2:
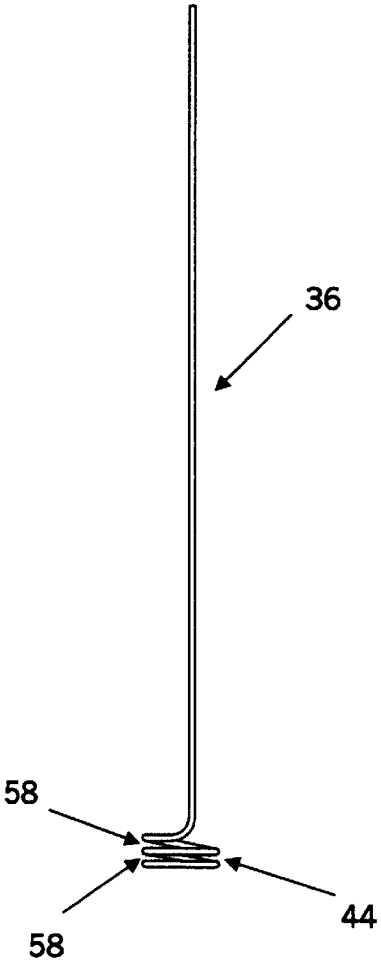
FIG. 2 is a view of one of the upstanding flag-bearing standards that is removably securable to a visor.
Figure 3:
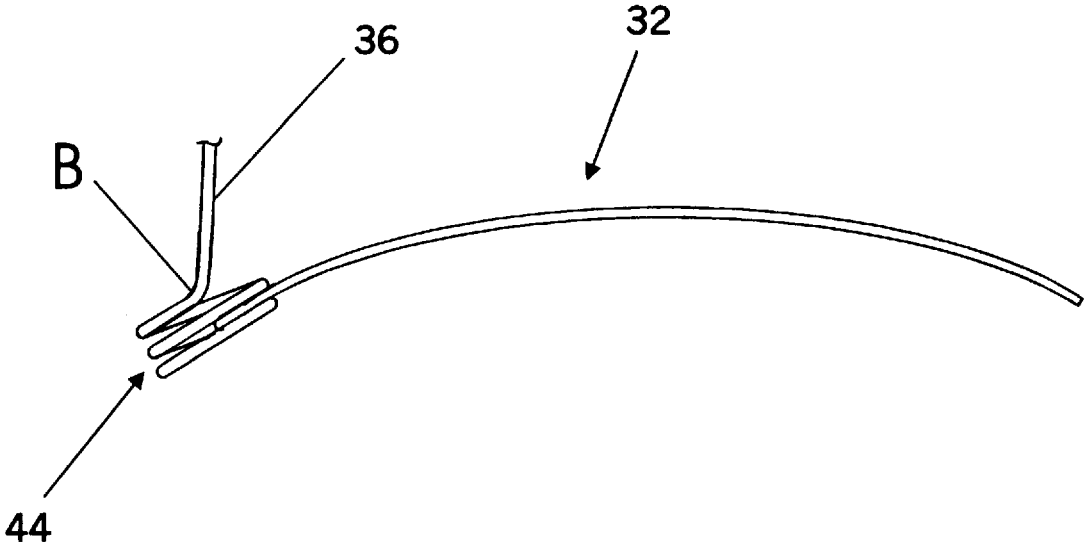
FIG. 3 is an enlarged view of the standard at its point of attachment to the visor.

FIG. 2 illustrates one preferred form of a standard that is integrally formed with the securement structure in a unitary fashion. Standard 36 preferably is formed of a wire material of sufficient length, for example eight inches, to serve as the upstanding support for the flag which is secured to the first, upper end of the standard. Securement structure 44 is at the second, lower end of the standard. Securement structure 44 takes the form of a coil comprising several loops of the wire material. As best shown in FIG. 3, a marginal edge portion of visor 32 may be pressed between two adjacent loops of the coil for removable securement of the flag assembly to the visor.

In one particular embodiment, standard 36 is formed of nylon-coated steel spring wire of suitable diameter, for example a diameter on the order of 0.062 inches. The integrally formed coil of the securement structure may consist of any suitable number of turns of wire, with a coil having 2 ¼ turns having been found suitable. A continuous gap 58 between the adjacent loops of the coil is desirable to facilitate press fitting the visor between the loops. A gap on the order of ⅛ inch has been found suitable for this purpose. While the coil diameter is not critical, a diameter on the order of ⅞ has been found suitable. It will be appreciated that standard 36 and the associated unitary coil may be conveniently and inexpensively produced utilizing conventional coil spring manufacturing technology.

One advantage of the coil securement structure is that the coil is essentially universally accessible to the visor about the full 360 degrees of the coil. Thus, even with a flag fixedly secured to the standard, the coil securement structure may be rotated before or after it engages the visor to orient the flag as desired, for example, to orient the flag so that it will be parallel with another flag located on the opposite side of the visor.

The material of standard 36 preferably is chosen so that it may be bent to provide a substantially vertical orientation for the standard when it is secured to a visor. With reference to FIG. 3, this bending most desirably occurs at point B, where the first turn of the coil meets the elongated straight portion of the standard.

The above described abilities to orient the flag and standard are important in view of the variation in visor styles and shapes, variations in the manner in which individuals wear their headwear and the tendency of individuals to shape and bend their visors to their liking.

The nylon coating on the standard is desirable because it presents a more aesthetically pleasing feel and appearance and also because the nylon may be colored to match or complement the team colors.

Figure 4:
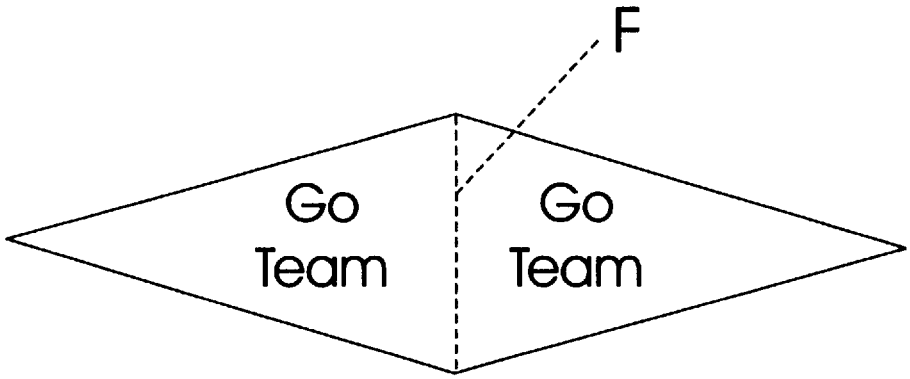
FIG. 4 is an enlarged view of the printed side of one of the flags in its laid-flat orientation before it is attached to the standard.

FIG. 4 shows the printed side of a typical flag of the invention in a laid-flat orientation prior to attachment to the standard. In a preferred embodiment, the flag is formed from thin paper or paper-like sheet material, having one side printed with team colors and/or logo and the other side bearing a peel-away layer that exposes adhesive. The flag is symmetrical about a fold line F so that when the adhesive is exposed, fold line F may be brought into engagement with the first upper end of the standard and the mirror image halves of the adhesive side of the flags joined, to thereby adhere the flag to the standard and permit the so adhered flag to present its printed subject matter on both sides.

One preferred manner of practicing the invention is to package the standards and flags unassembled in pairs. Thus, upon purchasing a kit containing a pair of standards and a pair of flags, a sports team enthusiast simply opens the package, attaches a flag to the first upper end of each standard and then secures the assemblies to two chosen positions on the headwear visor, preferably on opposite sides as shown in FIG. 1. Then, through a simple adjustment process, the wearer may rotate the coil securement structures to properly orient the flags and bend the standards at respective points B to assure their desired (e.g. vertical) orientation.

FIGS. 5–10 illustrate an alternative embodiment of the invention wherein a flag assembly 130 includes a three-piece structure comprising a flag 140, a standard 136 and a bracket 160 that serves as the securement structure for removably securing the second lower end of the standard to the visor. According to this alternative embodiment, flag 140 may be essentially identical to the flag described above in connection with the embodiment of FIGS. 1–4. Standard 136 is an L-shaped piece of elongate material, for example, the same nylon coated spring steel wire described above. Standard 136 defines an elongate upstanding portion 137 joined at a right angle R to a base portion 138, with the base ending at point 139.

Figure 5:
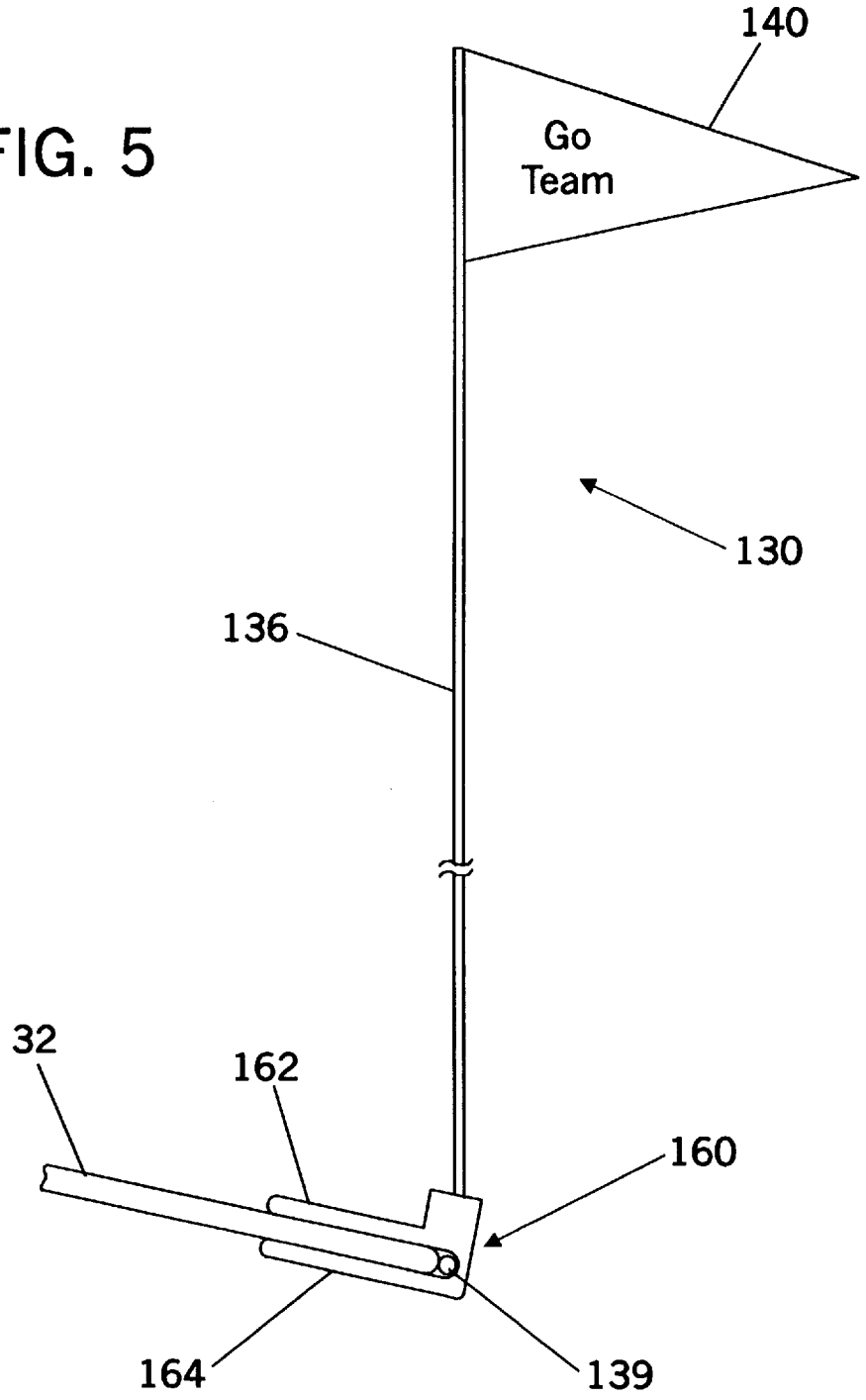
FIGS. 5 is a view of an alternative embodiment incorporating a modified standard that removably attaches to the visor by means of a slide-on bracket.
Figure 7:
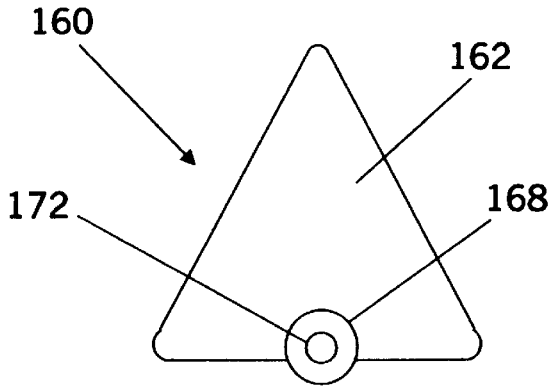
FIGS. 7–10 are top, bottom, side and end views, respectively, of the slide-on bracket of the embodiment of FIG. 5.
Figure 8:
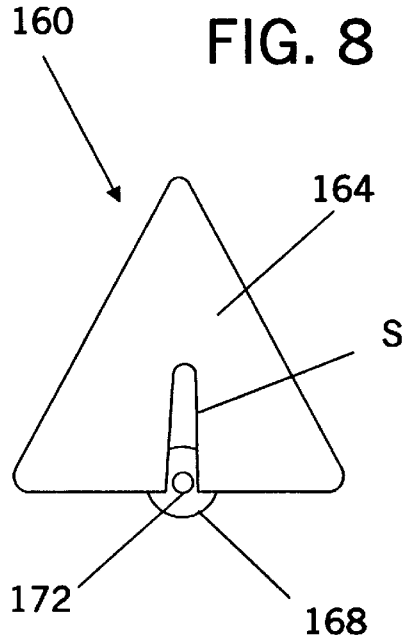
Figure 9:
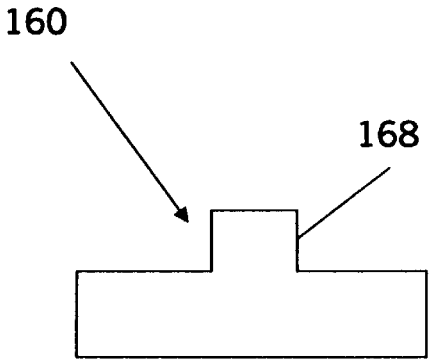
Figure 10:
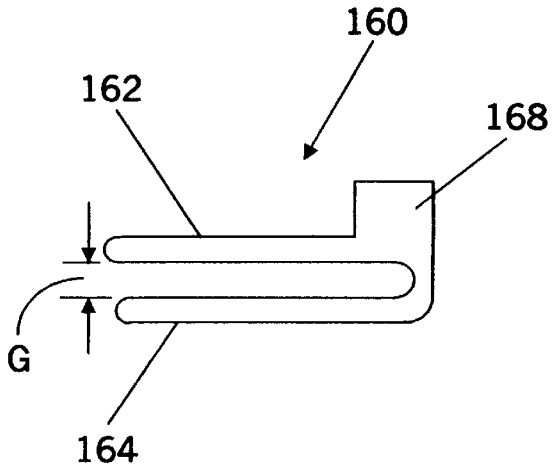

Bracket 160 has a triangular shape as viewed from the top or bottom and includes visor-engaging portions 162 and 164 that are spaced apart by a gap G, suitable to permit the respective facing surfaces of portions 162, 164 to engage the opposing sides of a visor and be removably secured thereto by friction retention. Bracket 160 includes an upstanding grommet 168 with a central opening 172 that communicates with a slot S in the lower engagement portion 164. Opening 172 is sized to receive the steel wire from which standard 136 is formed. The operation for assembling the three-piece flag assembly 130 and thereafter removably attaching it to visor 32 is as follows. First, the upper end of standard 136 is directed into opening 172 of grommet 168 from the bottom and pushed through opening 172 for the entire length of elongate portion 137 until base portion 138 passes through slot S and resides in the gap G between bracket top and bottom portions 162, 164. Next, standard 136 is rotated 90 degrees about the longitudinal axis of upstanding portion 137 so that base portion 138 turns 90 degrees and is normal to slot S. In this orientation, bracket 160 is slid onto visor 32 to hold flag assembly 130 to the visor by a friction engagement with bracket portions 162, 164 and with the base 138 of the standard locked in position by an engaging edge of the visor (FIG. 5). Next, the standard may be bent, preferably just above bracket 160, to a desired (e.g. vertical) orientation when the headwear is being worn. Lastly, the flag may be attached to the upper end of standard 136 at a desired orientation.

Figure 11:
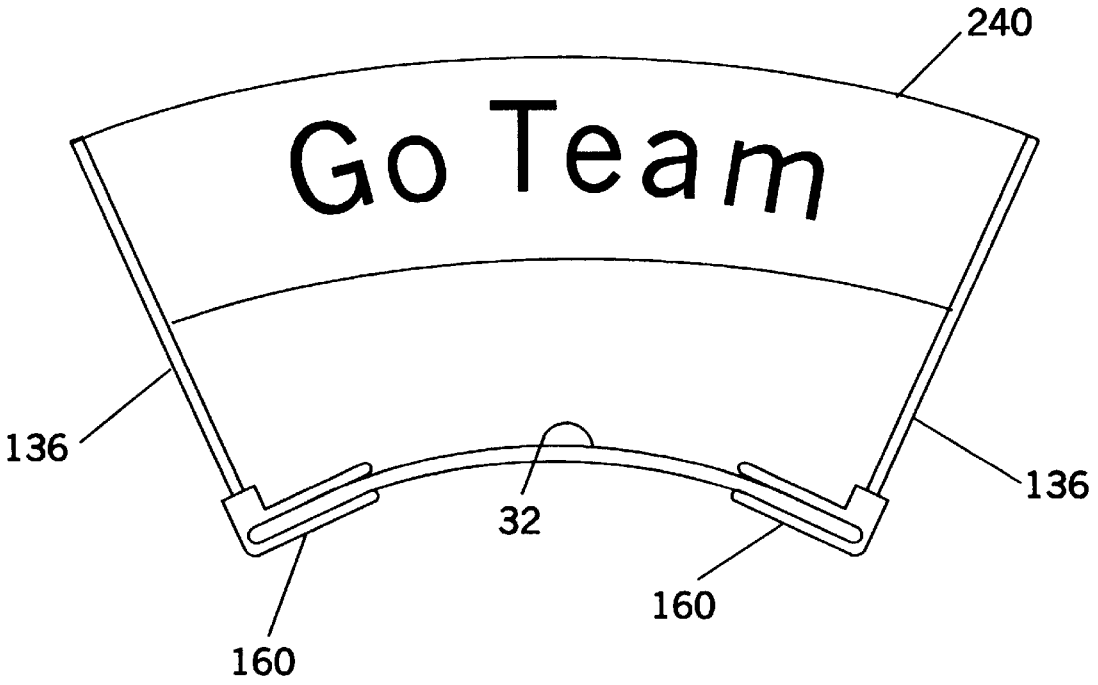
FIG. 11 is a view of another alternative embodiment incorporating two upstanding standards removably secured to a visor and carrying a single banner.

FIG. 11 is a view of another alternative embodiment wherein a pair of standards 136 are fixed to opposing sides of a visor 32 for supporting a banner 240 that extends between the two standards. Banner 240 may be formed of a sheet material with a peel-away layer covering an adhesive, so that it is attached to the two standards after the standards have been secured to the visor. It is preferred that the banner material be somewhat more rigid than the flag material in order to enhance its ability to maintain its shape in use.

Figure 12:
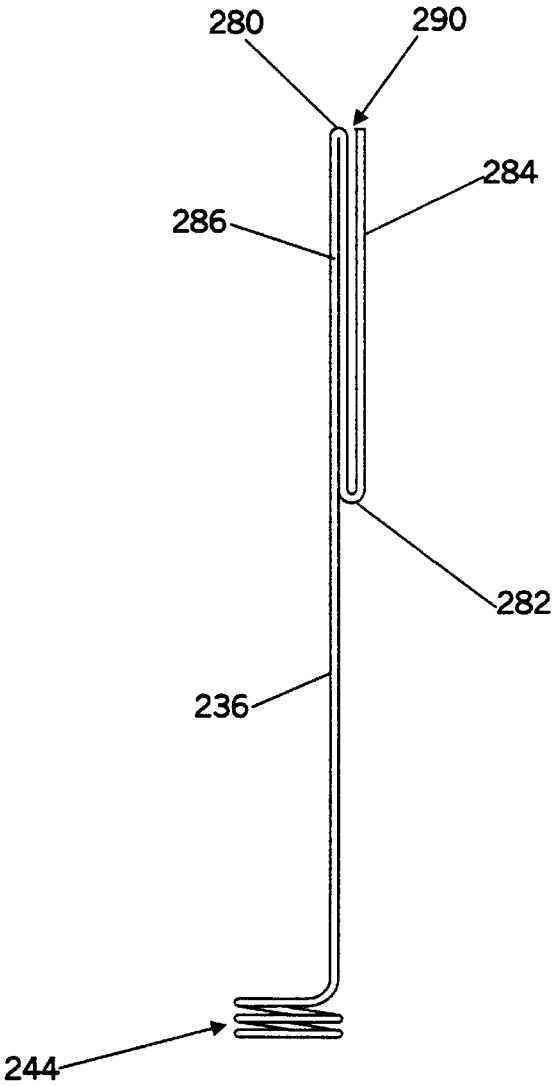
FIG. 12 is view of the standard and unitary coil securement structure of another alternative embodiment that carries both a banner and two flags.
Figure 6:
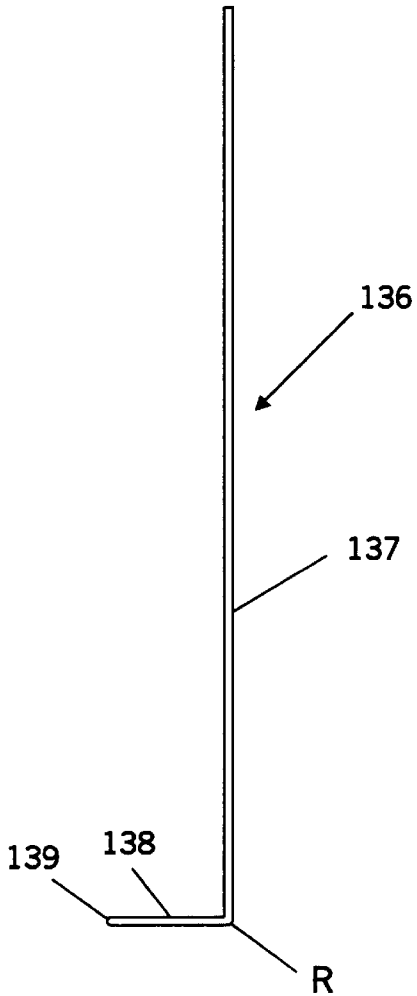
FIG. 6 is a view of the modified standard of the embodiment of FIG. 5.
Figure 13:
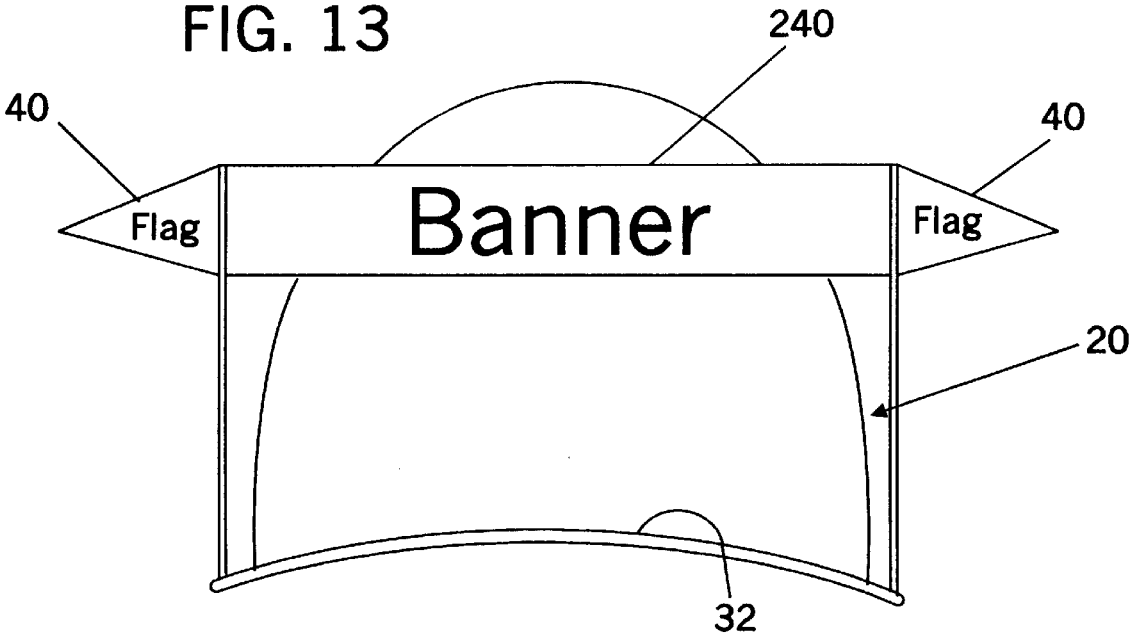
FIG. 13 is a view of two of the devices of FIG. 12 secured to a visor and carrying a banner and two flags.

Another alternative embodiment will now be described with reference to FIGS. 12 and 13. FIG. 12 shows a standard 236 with an integrally formed securement structure in the form of a coil 244. Standard 236 and coil 244 may be formed of the same nylon-coated steel spring wire described in connection with the embodiment of FIGS. 1–3, with the only difference being that the first, upper end of standard 236 has means for carrying both a flag and one end of a banner. In the illustrated embodiment, standard 236 has two 180 degree bends at 280 and 282 that form a flag carrying portion 284 and a banner carrying portion 286 that are separated by a gap 290. Bends 280, 282 may be formed by conventional wire bending techniques well known in the art. Referring to FIG. 13, flags 40 are secured to the flag carrying portions 284 of two standards, while a banner 240 is secured to the two banner carrying portions 286 and spans the space between the two standards. The standards are removably secured to opposite sides of the visor using the coils in the manner described above, with the standards being bendable and rotatable to adjust their orientation as worn.

While the invention has been described in connection with certain illustrated embodiments, it will be appreciated that modifications may be made without departing from the true spirit and scope of the invention. For example, it will be appreciated that the flags of the present invention are not limited in their use to the display of sports team loyalty. The flags may be used for other suitable purposes. One example is eye level advertising such as the display of new product information or "specials" information by fast food restaurant workers. Another example is use by those attending "rallies" or political conventions. It will also be appreciated that the term "flag" is used herein in a non-limiting sense to include any information-conveying display, whether rigid, semi-rigid or pliant, that is carried by the standard, such as pennants, banners, flags, streamers, insignias, or the like. Lastly, it will be appreciated that the securement structure for securing the standard to a visor may take other suitable forms, for example, a clamp structure such as an "alligator clip". These and other variations are deemed to be within the scope of the invention.

I claim:

1. A flag assembly for attachment to a headwear visor, said flag assembly comprising:

an elongate standard having a first end and a second end;

a flag carried by the standard at said standard first end; and a securement structure at the second end of said standard for securing the standard to a visor, said securement structure permitting rotation of the standard substantially about its longitudinal axis so that the flag carried thereon may be oriented as desired.

2. The flag assembly of claim 1 wherein said standard is bendable to permit desired orientation of the standard after the assembly has been attached to a visor.

3. A flag assembly for attachment to a headwear visor, said flag assembly comprising:

an elongate standard having a first end and a second end;

a flag carried by the standard at said standard first end;

a securement structure at the second end of said standard for securing the standard to a visor, and said standard being bendable to permit desired orientation of the standard after the assembly has been attached to a visor.

4. A flag assembly for attachment to a headwear visor, said flag assembly comprising:

an elongate standard comprising metal wire, said standard having a first end and a second end;

a flag carried by the standard at said standard first end; and a securement structure at the second end of said standard for securing the standard to a visor.

5. The flag assembly of claim 4 wherein said metal wire is a spring steel wire.

6. The flag assembly of claim 5 wherein said securement structure comprises a coil formed at the second end of said standard.

7. A flag assembly for attachment to a headwear visor, said flag assembly comprising:

an elongate standard formed of bendable material, said standard having a first end for carrying a flag and a second end joining to an integrally formed coil of said bendable material, said coil defining a securement structure whereby the standard may be removably secured to a visor with a marginal edge portion of the visor residing between two adjacent turns of the coil; and a flag carried by the standard at said standard first end.

8. A method of using the flag assembly of claim 7 comprising attaching the standard to a visor with a marginal edge portion of the visor residing between two adjacent turns of the coil and turning the coil and standard substantially about the longitudinal axis of the standard to achieve a desired orientation for the flag.

9. The method of claim 8 including the step of bending the standard at a selected point above the coil securement structure to achieve a desired orientation for the standard.

10. A method of using the flag assembly of claim 7 comprising attaching the standard to a visor with a marginal edge portion of the visor residing between two adjacent turns of the coil and bending the standard at a selected point above the coil securement structure to achieve a desired orientation for the standard.

11. The flag assembly of claim 7 wherein said elongate standard is formed of wire.

12. A flag assembly for attachment to a headwear visor, said flag assembly comprising:

an elongate standard having a first end and a second end;

a flag carried by the standard at said standard first end; and a securement structure comprising a coil at the second end of said standard for securing the standard to a visor.

13. The flag assembly of claim 12 wherein said flag carries team loyalty information with respect to a sports team.

14. The flag assembly of claim 12 wherein said flag carries advertising information.

15. A method of using the flag assembly of claim 12 comprising attaching the standard to a visor with a marginal edge portion of the visor residing between two adjacent turns of the coil and bending the standard above the coil securement structure to achieve a desired orientation for the standard.

16. A headwear/flag display combination comprising:

a cap having a visor;

an elongate standard having a first end and a second end;

a flag carried by the standard at said standard first end; and a securement structure at the second end of said standard securing the standard to the visor.

17. The headwear/flag display combination of claim 16 wherein said flag carries team loyalty information with respect to a sports team.

18. The headwear/flag display combination of claim 16 wherein said flag carries advertising information.

19. The headwear/flag display combination of claim 16 wherein said securement structure comprises a coil at the second end of said standard.

20. A method of using the headwear/flag display combination of claim 19 comprising attaching the standard to the visor with a marginal edge portion of the visor residing between two adjacent turns of the coil and bending the standard above the coil securement structure to achieve a desired orientation for the standard.

* * * * *